US007954271B1

(12) United States Patent
Bentley et al.

(10) Patent No.: US 7,954,271 B1
(45) Date of Patent: Jun. 7, 2011

(54) FIREARM MONOPOD

(75) Inventors: James K. Bentley, Paso Robles, CA (US); Ryan T. Cowgill, Fruitland, ID (US)

(73) Assignee: Krow Innovation, LLC, Paso Robles, CA (US)

( * ) Notice: Subject to any disclaimer, the term of this patent is extended or adjusted under 35 U.S.C. 154(b) by 0 days.

(21) Appl. No.: 12/773,122

(22) Filed: May 4, 2010

(51) Int. Cl.
*F41C 23/00* (2006.01)

(52) U.S. Cl. ..... 42/71.01; 42/71.02; 42/72

(58) Field of Classification Search ..... 42/71.011, 42/71.02, 72
See application file for complete search history.

(56) References Cited

U.S. PATENT DOCUMENTS 4,844,390 A * 7/1989 Duke ..... 248/118
5,345,706 A * 9/1994 Brown ..... 42/94
6,487,807 B1 * 12/2002 Kopman et al. ..... 42/94
7,631,455 B2 * 12/2009 Keng et al. ..... 42/94
7,743,545 B1 * 6/2010 Moody et al. ..... 42/94
7,793,454 B1 * 9/2010 Beltz ..... 42/94
2005/0188597 A1 * 9/2005 Keng et al. ..... 42/94
2006/0185214 A1 * 8/2006 Long ..... 42/71.02
2008/0052979 A1 * 3/2008 Lee et al. ..... 42/94
2009/0045304 A1 * 2/2009 Faifer ..... 248/188.5
2009/0126250 A1 * 5/2009 Keng ..... 42/94
2010/0084524 A1 * 4/2010 Faifer ..... 248/170

* cited by examiner

*Primary Examiner* — Troy Chambers
*Assistant Examiner* — Samir Abdosh
(74) *Attorney, Agent, or Firm* — Zarian Midgley & Johnson PLLC

(57) ABSTRACT

A monopod for a firearm is disclosed. The monopod has a body and a leg that can extend from the body. The monopod may fit into a pistol grip of a firearm, such as a rifle. Once installed, the leg of the monopod may be extended from the pistol grip of the firearm and secured by a pin. When the leg is retracted into the body, the leg is kept in place by the pin, which opposes a force provided by a constant force spring. The monopod may be used by a user to stabilize the firearm on a surface.

14 Claims, 3 Drawing Sheets

FIREARM MONOPOD

BACKGROUND OF THE INVENTION

1. Field of the Invention

The present application relates generally to firearm accessories. More specifically, the present application relates to an extension from a firearm that a user may employ to steady the firearm, such as before discharging the firearm.

2. Description of the Related Art

Device stabilizers such as monopods, bipods, tripods, etc., are known in the art and have been used for some time by shooters to steady a firearm prior to discharge, among other uses. A stabilizer is typically connected to the front of the firearm to steady the barrel as a shooter positions the firearm. Generally, the stabilizer is carried as an accessory, separate from a firearm, and is connected to the firearm when needed. The stabilizer may be attached to the firearm, then positioned on the ground, or on another such stable platform to assist with accuracy, if the firearm is discharged.

Stabilizers that are substantially permanently attached to firearms have also been used. Typically, the stabilizer is connected by a pivot to a firearm, such as on a forend, so that it may be tucked away before and after use. For extra space savings, some stabilizers have telescoping designs or the ability to be tucked into spaces hidden within the firearm stock and/or firearm accessories.

SUMMARY OF THE INVENTION

An accessory is disclosed. One embodiment of the accessory may comprise a body including a recess with one leg configured to be positioned within a portion of the recess. The accessory may further comprise a first securing mechanism. The first securing mechanism may be configured to selectively secure the leg to the body. The accessory may further comprise an actuator. The actuator may be configured to selectively disengage the first securing mechanism. Disengaging the first securing mechanism may release the leg from the body. The body may be configured to be positioned within a portion of a handgrip.

The first securing mechanism may comprise a plurality of notches formed into the leg. The first securing mechanism may further comprise a pin connected to the actuator. The pin may be configured to engage one of the plurality of notches. The accessory may further comprise a spring. The spring may have a first end connected to the body and a second end connected to the at least one leg. The spring may be a constant force spring. The accessory may further comprise a connector. The accessory may further comprise a projection. The spring may be connected to the leg with the connector. The spring may be connected to the body with the projection. The spring may be configured to move the leg out of the recess when the first securing mechanism is disengaged. The accessory may further comprise a foot connected to the at least one leg. The foot may comprise a fine adjustment. The accessory may further comprise a second securing mechanism. The second securing mechanism may connect to the body. The second securing mechanism may be configured to secure the accessory to a handgrip. The second securing mechanism may comprise an opening formed within a tang. The tang may be connected to the body.

A firearm monopod is disclosed. The firearm monopod may comprise a body including a recess. The firearm monopod may further comprise a single leg. The single leg may be configured to be positioned within a portion of the recess. The firearm monopod may further comprise a constant force spring. The constant force spring may be connected to the leg. The constant force spring may further connect to the body. The firearm monopod may further comprise a first securing mechanism. The first securing mechanism may connect to the body. When engaged, the first securing mechanism may be configured to secure the leg. The first securing mechanism may be configured to release the leg when disengaged. The firearm monopod may further comprise an actuator. The actuator may be configured to engage or disengage the first securing mechanism.

The first securing mechanism may comprise a plurality of notches formed into the single leg. The first securing mechanism may further comprise one or more pins configured to engage one or more of the plurality of notches. The firearm monopod may be configured to be positioned within a portion of a handgrip. The handgrip may be a pistol grip. The pistol grip may be connected a firearm stock. The actuator may be a button that is connected to the securing mechanism. The firearm monopod may further comprise a foot connected to the leg.

A handgrip is disclosed. The handgrip may comprise a recess formed within the handgrip. The handgrip may further comprise a monopod. The monopod may be secured partly or wholly within the recess. The monopod may comprise a single leg. The monopod may further comprise a securing mechanism. The securing mechanism may comprise a plurality of notches. The plurality of notches may be formed into the single leg. The securing mechanism may further comprise one or more pins configured to engage with one or more of the plurality of notches. The monopod may further comprise an actuator configured to actuate the securing mechanism.

The single leg of the handgrip may be configured to be extended from the monopod. The single leg may be configured to extend from the monopod to a plurality of different lengths. The single leg may be configured to be secured by the securing mechanism. The single leg may be configured to be secured by the securing mechanism at the plurality, of different lengths. The handgrip may be configured to be secured of connected to a firearm. The handgrip may be a portion of a firearm stock.

These and other embodiments of the present application will be discussed more fully in the description. The features, functions, and advantages can be achieved independently in various embodiments of the claimed invention, or may be combined in yet other embodiments.

BRIEF DESCRIPTION OF FIGURES

Like reference numbers and designations in the various drawings indicate like elements.

DETAILED DESCRIPTION

In the following description, reference is made to the accompanying drawings that form a part thereof, and in which is shown by way of illustration specific exemplary embodiments in which the invention may be practiced. These embodiments are described in sufficient detail to enable those skilled in the art to practice the invention, and it is to be understood that modifications to the various disclosed embodiments may be made, and other embodiments may be utilized, without departing from the spirit and scope of the present invention. The following detailed description is, therefore, not to be taken in a limiting sense.

Figure 2:
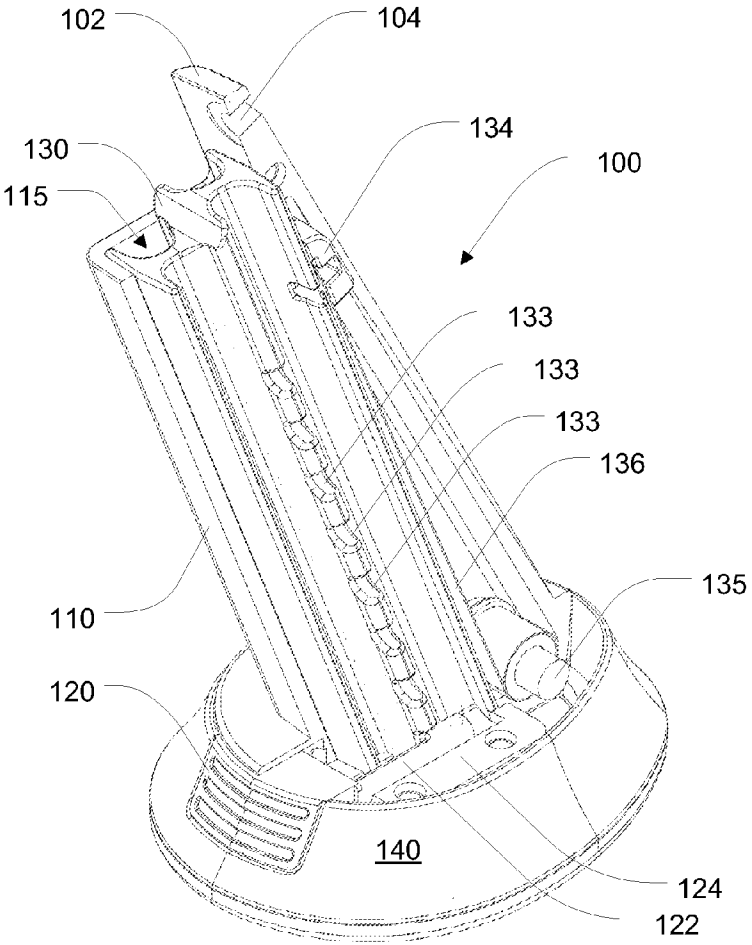
FIG. 2 is a cutaway perspective view of the embodiment of FIG. 1.
Figure 1:
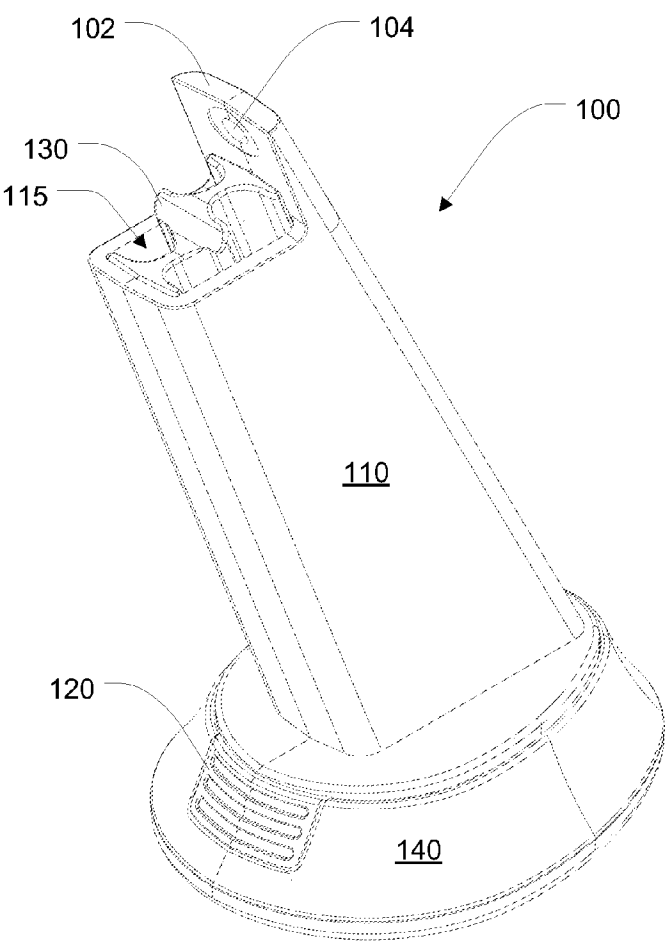
FIG. 1 is a perspective view of an embodiment of a monopod, in a retracted position.

FIGS. 1 and 2 are perspective views of an embodiment of a monopod 100 in accord with the current disclosure. FIG. 2 has been cutaway to shown internal components and the positions of those components. The monopod 100 comprises a body 110 that has a recess 115. A leg 130 is positioned within the recess 115. A foot 145 (shown in FIGS. 3 and 4) is connected to the leg 130 and a shoe 140 is connected to the foot 145.

As shown in FIG. 2, the leg 130 comprises a plurality of notches 133, three of which are called out for purposes of demonstration, and a pin 122 that is engaged with one of the plurality of notches 133. As shown in FIG. 2, the pin 122 is securing the leg 130 in a retracted position. The pin 122 is held in place by a pin guide 124, positioned opposite the leg 130. Additionally, an actuator 120 such as a button ("actuation button 120") connects to the pin 122 and to a portion of the body 110. The actuation button 120 may be pushed to move the pin 122 such that it is not engaged with one of the plurality of notches 133. When the pin 122 is not engaged with one of the plurality of notches 133, the leg 130 may be extended out of the recess 115 and away from the body 110. A spring (not shown) may be positioned to provide a return force on the pin 122 and/or the actuation button 120. The pin 122 may be re-engaged with one of the plurality of notches 133 to re-secure the leg 130 relative to the body 110. The monopod 100 may further comprise a second pin (not shown) and a second plurality of notches (not shown) on the opposite side of the leg 130. When the leg 130 is fully retracted within the recess 155, the monopod 100 is said to be in a retracted position, as shown in FIGS. 1 and 2.

The body 110 may further comprise a tang 102 and an opening 104. The tang 102 is positioned near the top of the body 110 and may be used to secure the body 110, and thus the monopod 100, to a firearm 200 (shown in FIG. 6). For example, a fastener such as a screw (not shown) may be positioned through the opening 104 and into a complementary opening in the firearm 200, securing the tang 102 to the firearm 200.

Also shown in FIGS. 1 and 2 is a spring connector 134 and a spring 136. In the embodiment illustrated by FIG. 2, the spring 136 is connected to the body 110 with a projection 135 that is connected to the body 110. The spring 136 may be a constant force spring or another suitable type of spring or spring-like mechanism, as would be apparent to one of ordinary skill in the art, given the benefit of this disclosure. A constant force spring, for example, may provide a user the feeling of constant pressure on the leg 130 of the monopod 100 as it extends, thus making is predictable and easy to control. A constant force springs may be constructed as a rolled ribbon of spring steel that, as the ribbon unrolls, has a force that is nearly constant.

The spring 136 extends to the spring connector 134, which is connected to the leg 130. When in a retracted position, the spring 136 exerts a force on the leg 130, which is opposed by the pin 122 when the pin 122 is engaged with one of the plurality of notches 133. As such, if the pin 122 is not engaged with one of the plurality of notches 133, the leg 130 may extend out of the recess 115 and away from the body 110 due to the force of the spring 136. The movement may be opposed or stopped by the connector 134 as it meets the spring 136 and/or the projection 135, or by reengaging the pin 122 with one of the plurality of notches 133, or by another suitable mechanism or stop, as would be apparent to one of ordinary skill in the art, given the benefit of this disclosure.

As shown in FIG. 2, the spring 136 and connector 134 are configured to provide a force for extending the leg 130 out of the recess 115. Alternatively, the spring 136 and connector 134 may be positioned to provide a force for retracting the leg 130, or for providing a force for both retraction and extension. Additionally, the spring 136 may be omitted from the monopod 100. When the spring 136 is omitted, the weight of the leg 130 may provide the force for extension and/or retraction. Also, a user may manually provide a force for extension and/or retraction of the leg 130.

The foot 145 may comprise a hard plastic material and may be formed as a portion of the leg 130. The shoe 140 may comprise an elastomeric material and may be molded over the foot 145. The shoe 140 may provide a firm, frictional surface for stabilizing a connected device, such as the firearm 200, shown in FIGS. 6 and 7. The foot 145 and shoe 140 may be integrated as a single component. Further, the leg 130, foot 145, and shoe 140 may be integrated as a single component as would be apparent to one of ordinary skill in the art, given the benefit of this disclosure.

Figure 4:
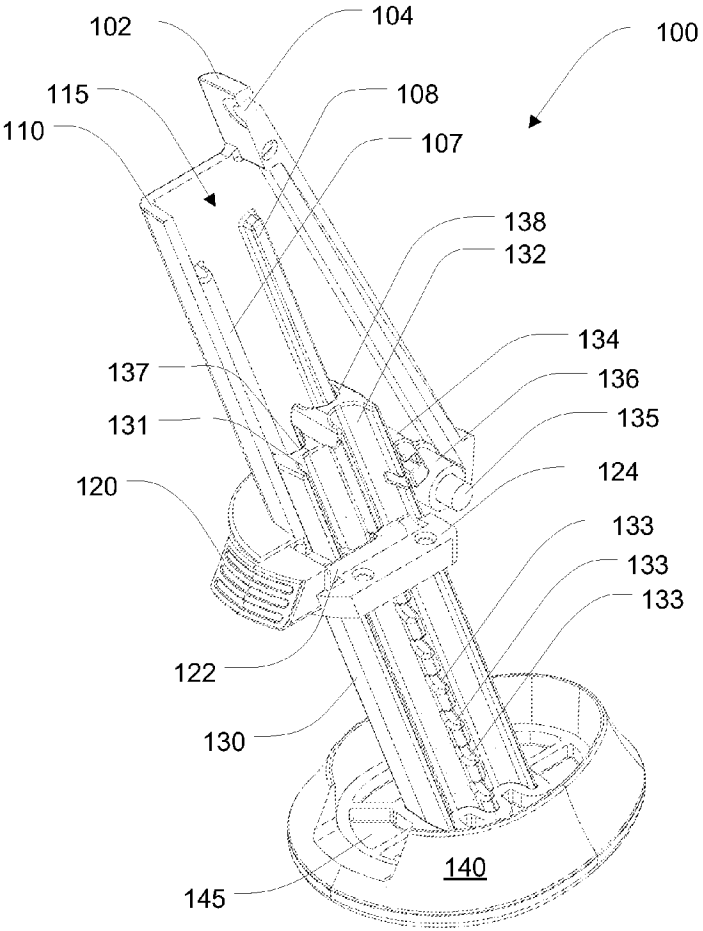
FIG. 4 is a cutaway perspective view of the embodiment of FIG. 3.
Figure 3:
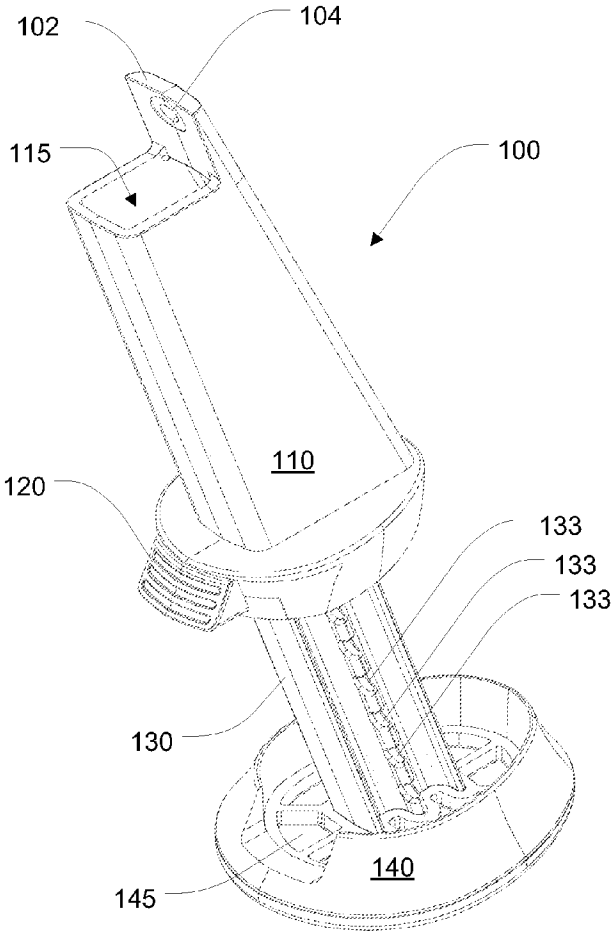
FIG. 3 is a perspective view of an embodiment of a monopod in an extended position.

FIGS. 3 and 4 are perspective views of an embodiment of a monopod 100 in an extended configuration. As shown, the leg 130 of the monopod 100 is extended from the recess 115 of the body 110 and the pin 122 is engaged with the lowest of the plurality of notches 133 on the leg 130. The leg 130 is selectively secured in this position by the pin 122.

The leg 130 may be extended from the monopod 100, for example, by applying a force to the actuation button 120, which may actuate (i.e. engage or disengage) a securing mechanism, which acts to secure the leg 130 in position. The securing mechanism may comprise, for example, the pin 122 and the pin guide 124. To extend the leg 130, for example, the pin 122 may be moved out engagement with one of the plurality of notches 133, thus releasing the leg 130 to be extended. The actuation button 120 may be interchangeable with other actuators, such as a lever, a pivoting actuator, or another suitable actuator, as would be apparent to one of ordinary skill in the art, given the benefit of this disclosure.

As shown, each the plurality of notches 133 can be engaged by the pin 122, allowing the leg 130 to extend from body 110 in a plurality of discrete extension lengths. The number of discrete extension lengths may be the same as the number of the plurality of notches 133. The leg 130 with a discrete number of extension lengths may not be as adjustable as required by a user. To increase the adjustability of the monopod 100, additional notches may be added to the plurality of notches 133. Alternatively or additionally, a fine adjustment (not shown) may be added to the monopod, such as by adding a threaded connector (not shown) to the leg 130, foot 145, or shoe 140. The fine adjustment contrasts the plurality of notches, which may be thought of as a coarse adjustment. For example, if the foot 145 comprises the fine adjustment, the foot 145 may be rotated in one direction to extend the foot 145 from the leg 130 and rotated in the other direction to retract the foot 145 toward the leg 130. With a fine adjustment, the number of extension lengths of the monopod 100 may be substantially infinite.

The body 110 may include a first guide 107 and a second guide 108, as can be seen in the cutaway view of the monopod 100 in FIG. 4. The first and second guides 107, 108 extend from the body 110 and into the recess 115. A first groove 137 and a second groove 138 may be formed into the leg 130 that complement the first and second guides 107, 108. When mated with the first and second grooves 137, 138, the first and second guides 107, 108 may hold the leg 130 in an alignment that allows for easy extension and retraction of the leg 130. A third and fourth guide (not shown) may also be attached to or project from the body 110, such as opposite the first and second guides 107, 108, may complement a third and fourth groove 131, 132 formed into the leg 130, and may act analogously to the first and second guides 107, 108.

Figure 5:
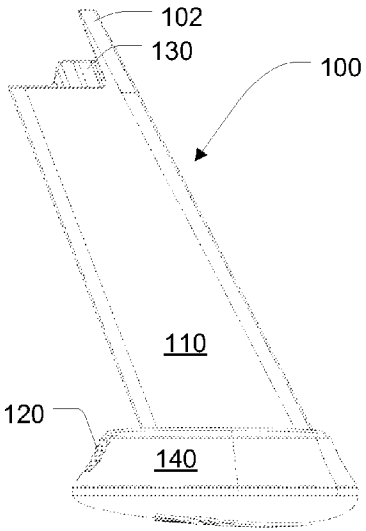
FIG. 5 is a side view of an embodiment of a monopod in a retracted position.
Figure 6:
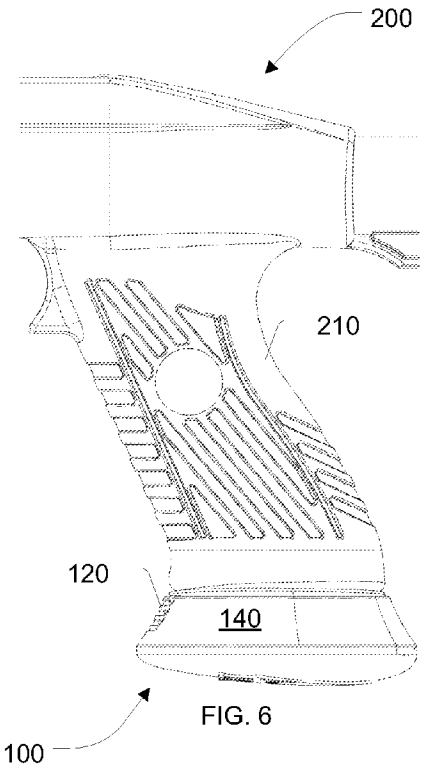
FIG. 6 is a side view of an embodiment of a monopod that is positioned in a handgrip of a firearm, with the leg in a retracted position.
Figure 7:
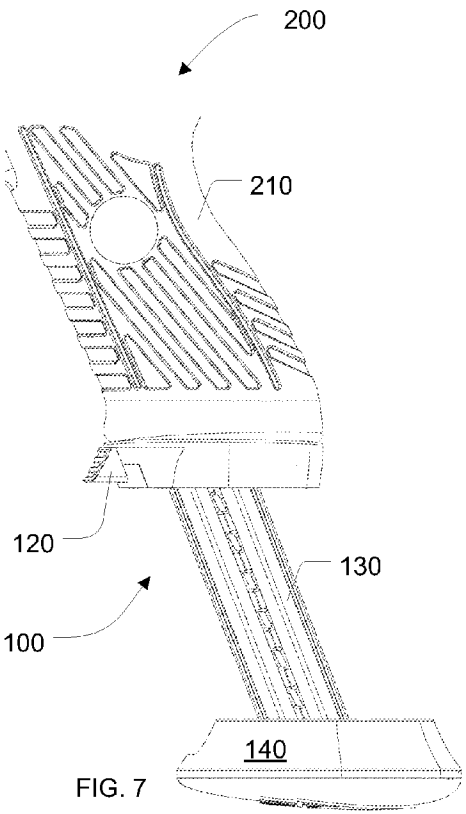
FIG. 7 is a side view of an embodiment of a monopod that is positioned in a handgrip that is connected to a firearm, with the leg in an extended position.

FIG. 5 is a side view of an embodiment of a monopod 100 comprising a body 110, a leg 130, a foot 145 (shown in FIGS. 3 and 4), a shoe 140, and the actuation button 120, as previously described. FIGS. 6 and 7 are side views of a firearm stock 200 comprising the monopod 100 shown in FIG. 5, in the same orientation. FIG. 6 shows the monopod in a retracted configuration and FIG. 7 shows the monopod in an extended configuration.

As shown in FIGS. 6 and 7, the monopod 100 may be fitted into the bottom of a handgrip 210, such as a pistol grip or another suitable portion of a firearm stock 200. The monopod 100 may be secured to the handgrip 210, such as, for example, by using a fastener (not shown), inserted through the opening 104 (shown in FIGS. 1, 2, 3, and 4), to secure the tang 102 of the monopod 100 to the handgrip 210. Alternatively, the monopod 100 may be secured to the handgrip 210, for example, by a lock with movable tang (not shown) that may be rotated into a complementary slot formed into the handgrip 210, or by another suitable mechanism, as would be apparent to one of ordinary skill in the art, given the benefit of this disclosure.

As shown in FIG. 7, the leg 130 has been extended from the monopod 100, increasing the length of the firearm handgrip 210, in effect increasing the height of the firearm stock 200 when set upon a base, such as a wall or another suitable shooting platform. The leg 130 may be allowed to extend by applying pressure to the actuation button 120, as previously described. Whether fully retracted, fully extended, or at extended between full retraction and full extension, the monopod 100 may supply a stable platform upon which a user may steady a connected device, such as the firearm stock 200.

Although this invention has been described in terms of certain preferred embodiments, other embodiments that are apparent to those of ordinary skill in the art, including embodiments that do not provide all of the features and advantages set forth herein, are also within the scope of this invention. Therefore, the scope of the present invention is defined only by reference to the appended claims and equivalents thereof.

What is claimed is:

1. An accessory comprising:

a body including a recess;

at least one leg configured to be positioned within a portion of the recess;

a first securing mechanism configured to selectively secure the at least one leg to the body, comprising a plurality of notches formed into the leg and at least one pin connected to the actuator, the at least one pin being configured to engage at least one of the plurality of notches;

an actuator configured to selectively disengage the first securing mechanism to release the at least one leg from the body; and a constant force spring, having a first end connected to the body and a second end connected to the at least one leg, wherein the body is configured to be positioned within a portion of a handgrip of a firearm.

2. the accessory of claim 1, further comprising a connector and a projection, the spring being connected to the leg with the connector and the spring being connected to the body with the projection.

3. The accessory of claim 1, wherein the spring is configured to move the leg out of the recess when the first securing mechanism is disengaged.

4. The accessory of claim 1, further comprising a foot connected to the at least one leg.

5. The accessory of claim 1, further comprising a second securing mechanism connected to the body, the second securing mechanism configured to secure the accessory to a handgrip.

6. The accessory of claim 5, wherein the second securing mechanism comprises an opening formed within a tang, the tang being connected to the body.

7. A firearm monopod comprising:

body including a recess, configured to be positioned within a portion of a handgrip of a firearm;

a single leg configured to be positioned within a portion of the recess;

a constant force spring connected to the leg and further connected to the body;

a first securing mechanism connected to the body and configured to secure the single leg when engaged and configured to release the single leg when disengaged, comprising a plurality of notches formed into the single leg and a pin configured to engage at least one of the plurality of notches; and an actuator configured to engage or disengage the first securing mechanism.

8. The firearm monopod of claim 7, wherein the handgrip is a pistol grip that is connected to a firearm stock.

9. The firearm monopod of claim 7, wherein the actuator is a button that is connected to the securing mechanism.

10. The firearm monopod of claim 7, further comprising a foot connected to the single leg.

11. The accessory of claim 1, wherein the at least one leg is configured to be extended from the body at a plurality of different lengths, and to be secured by the first securing mechanism at the plurality of different lengths.

12. The accessory of claim 1, wherein the handgrip is configured to be secured to a firearm.

13. The accessory of claim 1, wherein the handgrip is a portion of a firearm stock.

14. The firearm monopod of claim 11, wherein the single leg is configured to be extended from the body at a plurality of different lengths, and to be secured by the first securing mechanism at the plurality of different lengths.

* * * * *